United States Patent [19]

Kitagawa et al.

[11] Patent Number: 5,011,315

[45] Date of Patent: Apr. 30, 1991

[54] PRINTER

[75] Inventors: Toshiharu Kitagawa; Ryuji Nishiyama, both of Katano; Masaaki Takita, Ibaraki; Yoshikazu Tsuru, Hirakata, all of Japan

[73] Assignee: Matsushita Electric Industrial Co., Ltd., Osaka, Japan

[21] Appl. No.: 373,701

[22] Filed: Jun. 30, 1989

Related U.S. Application Data

[63] Continuation of Ser. No. 155,074, Feb. 11, 1988, abandoned.

[30] Foreign Application Priority Data

Feb. 18, 1987 [JP] Japan ..... 62-35039
Feb. 18, 1987 [JP] Japan ..... 62-35040

[51] Int. Cl.[5] ..... B41J 13/03

[52] U.S. Cl. ..... 400/624; 400/625; 400/636.2

[58] Field of Search ..... 400/624, 625, 628, 629, 400/636, 636.1, 636.2

[56] References Cited

U.S. PATENT DOCUMENTS

| | | | |
|---|---|---|---|
| 4,059,203 | 11/1977 | Wright | 226/88 |
| 4,178,601 | 12/1979 | King | 226/88 |
| 4,222,557 | 9/1980 | Wu | 400/629 |
| 4,533,270 | 8/1985 | Shimizu | 400/636 |
| 4,721,297 | 1/1988 | Katayama | 400/636.2 |
| 4,743,132 | 5/1988 | Chikata et al. | 400/629 |

FOREIGN PATENT DOCUMENTS

| | | | |
|---|---|---|---|
| 141576 | 6/1976 | Japan | 400/629 |
| 185675 | 10/1984 | Japan | 400/629 |
| 60-31982 | 2/1985 | Japan . | |
| 188247 | 9/1985 | Japan | 271/273 |
| 188255 | 9/1985 | Japan | 271/273 |
| 192641 | 8/1986 | Japan | 271/273 |

OTHER PUBLICATIONS

Mitrovich "Drive Mechanism . . . Feed Rollers", Xerox Disclosure Journal vol. 6, No. 2, pp. 53–54, Mar./Apr. 81.

*Primary Examiner*—Edgar S. Burr
*Assistant Examiner*—Joseph R. Keating
*Attorney, Agent, or Firm*—Stevens, Davis, Miller & Mosher

[57] ABSTRACT

The present invention relates to a printer, and more particularly to a heat transfer printer. The printer comprises: a pair of upper and lower chutes for guiding printed paper; an idle roller provided on the upper chute; a paper discharging motor bracket provided on the lower chute; a paper discharging lever rotatably provided on the paper discharging motor bracket; and a paper discharging pulley disposed at a tip of the paper discharging lever, wherein, at the time of discharging the paper, the paper discharging lever is rotated by a driving force of a motor provided on the bracket to cause the paper discharging pulley to project from the lower chute so as to come into contact with the idle roller, while, at the time of printing, the motor is stopped.

2 Claims, 6 Drawing Sheets

PRINTER

This application is a continuation of Ser. No. 155,074, filed Feb. 11, 1988, now abandoned.

BACKGROUND OF THE INVENTION

1. Field of the Invention

The present invention relates to a printer.

2. Description of the Prior Art

FIG. 1 is an exploded perspective view of a conventional heat transfer color printer. As shown in the drawing, the conventional heat transfer color printer comprises the following components or portions: a lower cabinet 1; a circuit portion 2; a power supply panel 3; a pinch roller 4; a capstan roller 5, against which the pinch roller 4 is adapted to abut to impart a driving force to the same; a platen roller 6, which, together with the pinch roller 4 and the capstan roller 5, constitutes a paper feeding mechanism; a main motor 7 for driving the pinch roller 4 and the platen roller 6; a pinch lever 8 adapted to be interlinked with the movement of a cam to cause the pinch roller 4 to be brought into contact with the capstan roller 5 or to cancel the contact thereof; a release roller 9 for releasing an ink film from paper; a paper feed roller 10 for bringing the paper into contact with the platen roller 6; a paper guide 11 for guiding the paper; and a paper support 12 for supporting the paper wound into the form of a roll. The printer further comprises a cover frame 13; a lock lever 14; a lock lever shaft 15, which engages or disengages with the lock lever 14 to open or close the cover frame 13; a ribbon feed gear 16 disposed on the cover frame 13 and adapted to effect positioning of one end of a ribbon feed in which an ink film is rolled; a ribbon holder 17 similarly disposed on the cover frame 13 and adapted to impart a pressing force against the other end of the ribbon feed; a head holder 18; a head 19 secured to the head holder 18; a head arm 20 which is interlinked with the operation of a cam and to which the head 19 is secured; a cooling fan 21 for radiating heat from the main motor 7, the circuit portion 2, and the like; an operation panel 22; a top cover 23; and an upper cabinet 24.

In the conventional heat transfer color printer, the paper feeding and printing are carried out in the manner illustrated in FIGS. 2*a* and 2*b*.

First, during paper feeding, as illustrated in FIG. 2*a*, by virtue of the counterclockwise rotational driving forces of the pinch roller 4 and the platen roller 6, the paper is fed from the paper holder 26 by an amount corresponding to one image plane in the direction of the arrow A. At this time, the head 19 is located away from the platen roller 6, the ink film 27 is in a stopped state, and printing is not effected.

Incidentally, in FIG. 2*a*, reference numeral 28 denotes an ink film holder, while numeral 29 denotes an ink film takeup holder.

During printing, as shown in FIG. 2*b*, the platen roller 6 and the pinch roller 4 rotate clockwise, and the paper 25 is thus unwound by the amount of one image plane in the direction of the arrow B. At this time, the head 19 is in contact with the platen roller 6, and the ink film holder 28 and the ink film takeup holder 29 rotate counterclockwise, so that the ink film 27 and the paper 25 are unwound in the direction of the arrow B in an interlinking relationship. Thus, heat is applied from the head 19 to the ink film 27, and predetermined printing is effected on the paper 25.

Incidentally, yellow, magenta, and cyan are arranged on the ink film sequentially for each image plane, and color printing is effected by repeating the above-described operation three times.

The printing section is arranged as described above. The paper for which printing has been completed is discharged to the outside by a paper discharging device. FIG. 3 is a partial perspective view of a conventional paper discharging device. In the drawing, upper and lower rollers 30, 31 are rotatively driven by a drive motor 32. Reference numerals 30*a*, 31*a* denote upper and lower shafts, respectively. Numerals 33, 34 are upper and lower chutes, respectively, and the paper is guided therebetween to be discharged.

With such an arrangement, however, it is necessary to machine the upper and lower shafts 30*a*, 31*a* with high precision, and a large number of components, including the drive motor 32, is required, thereby hampering a reduction in the costs.

In addition, in the case of a heat transfer color printer, in terms of its basic principle, it is necessary to reciprocate the paper a plurality of times, as described above. Accordingly, during printing, it is necessary to open the gap between the upper and lower shafts 30*a*, 31*b* and to prevent the advance of the paper 25 from being hindered by the upper and lower rollers 30, 31. At the time of discharging the paper, it is necessary to discharge the paper by bringing the upper and lower rollers 30, 31 into contact with each other. For this reason, there has been a drawback in that the paper discharging device is complicated.

SUMMARY OF THE INVENTION

Accordingly, it is a primary object of the present invention to provide a printer which is capable of overcoming the above-described drawbacks of the prior art.

To this end, according to the present invention, there is provided a printer comprising: upper and lower chutes for guiding printed paper; an idle roller provided on the upper chute; a paper discharging motor bracket provided on the lower chute; a paper discharging lever rotatably provided on the paper discharging motor bracket; and a paper discharging pulley disposed at a tip of the paper discharging lever, wherein the paper discharging lever is rotated by a driving force of a motor provided on the bracket to cause the paper discharging pulley to project from the lower chute so as to come into contact with the idle roller, thereby discharging the paper.

According to the present invention, since the paper discharging lever can be rotated by the motor provided on the bracket, the motor is stopped during printing, and during discharging of the paper the paper can be discharged simply by driving the motor.

Another object of the present invention is to provide a printer in which at least one side end portion of at least a lower chute on the paper discharging side is bent to prevent the paper from becoming curled into the form of a roll.

To this end, in accordance with another aspect of the present invention, there is provided a printer comprising: a paper holder with paper wound therearound; and a pair of upper and lower chutes for guiding the paper discharged from said paper holder, wherein a side end portion of the lower chute on the paper discharging side is bent in the opposite direction to the winding direction of the paper.

Figure 1:
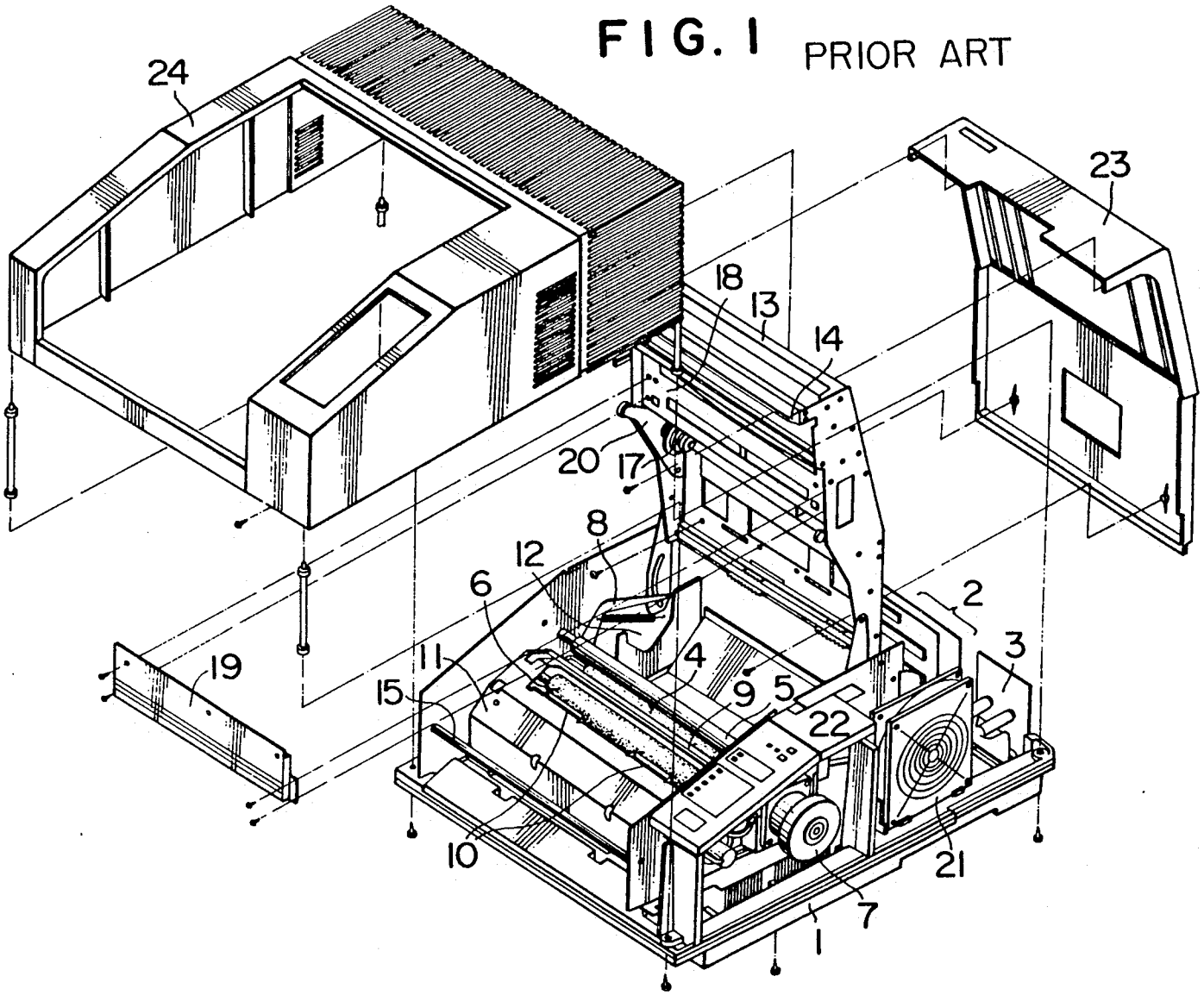
FIG. 1 PRIOR ART
FIG. 1 is an exploded perspective view of a conventional heat transfer color printer.
Figure 2A:
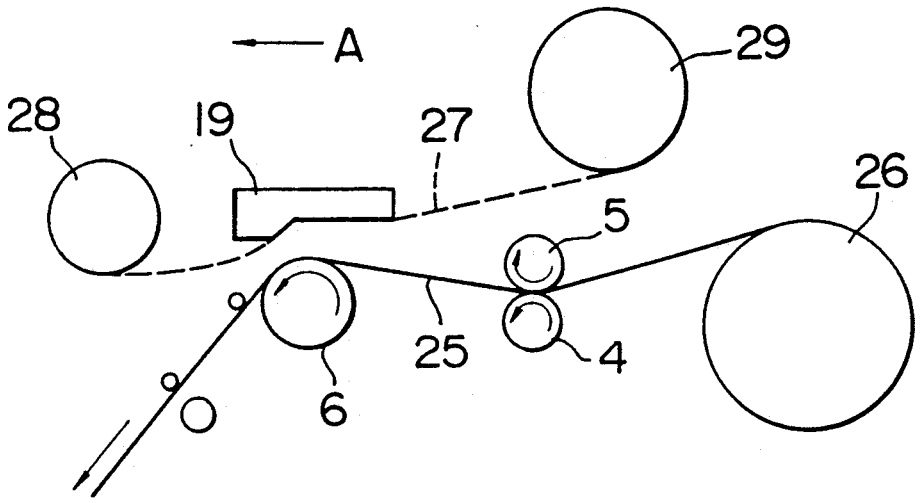
FIG. 2a PRIOR ART
Figure 2B:
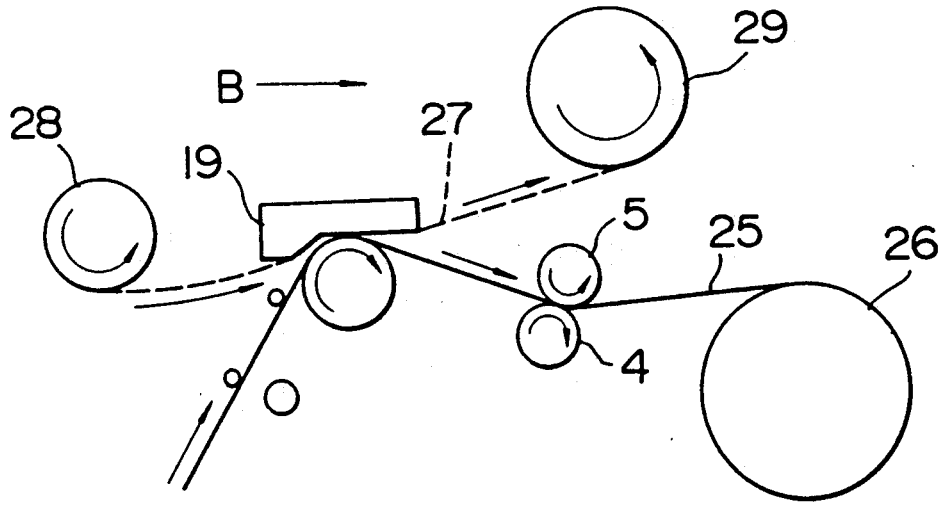
FIG. 2b PRIOR ART
Figure 3:
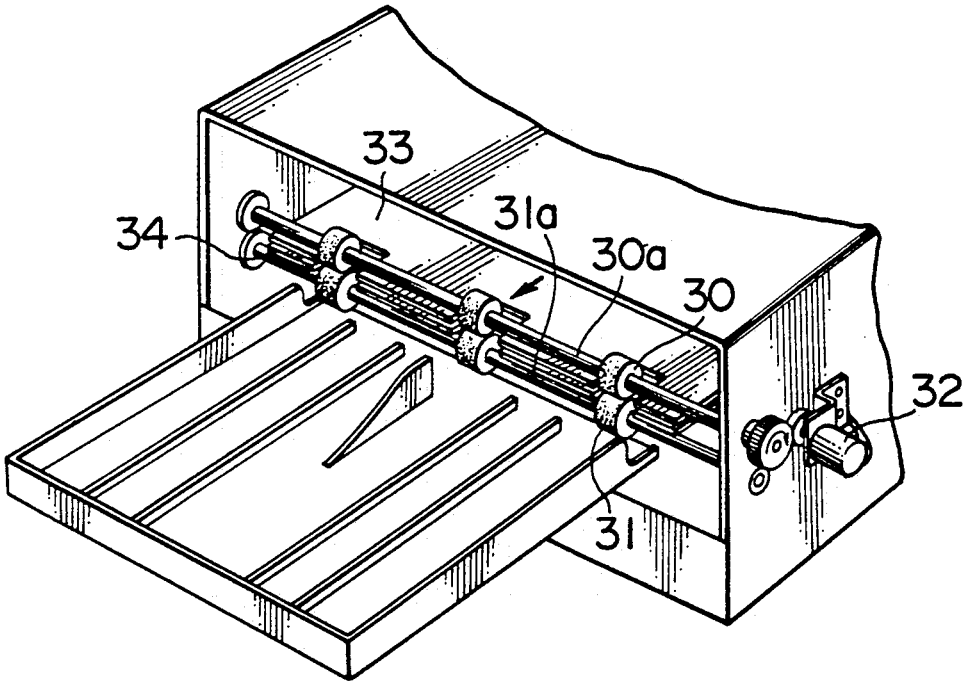
Figure 4A:
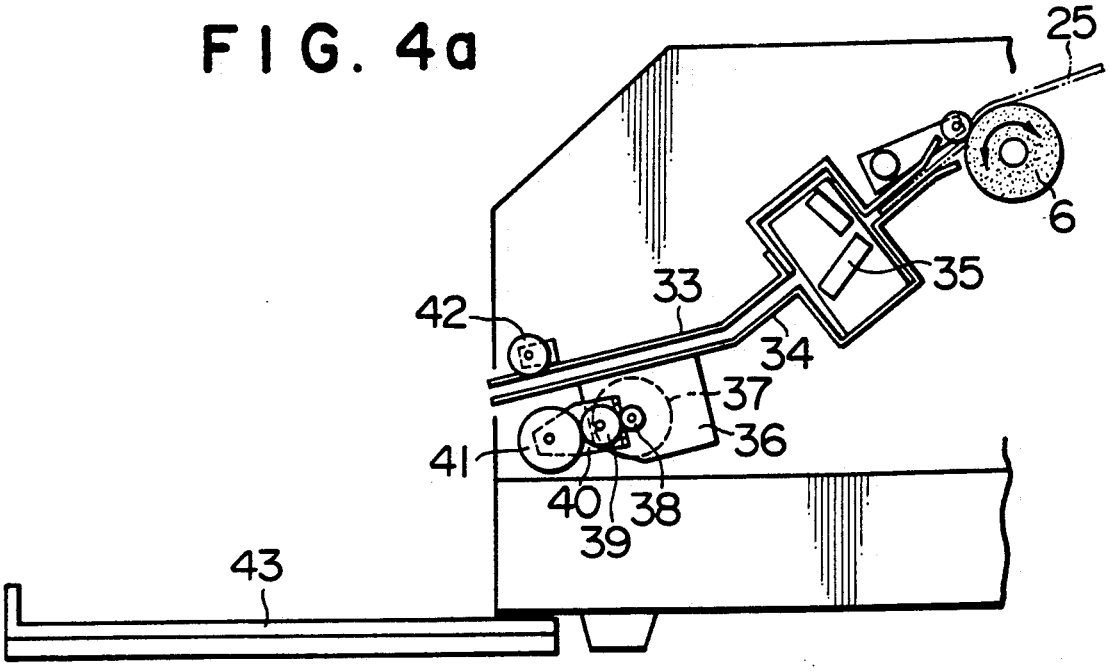
Figure 4B:
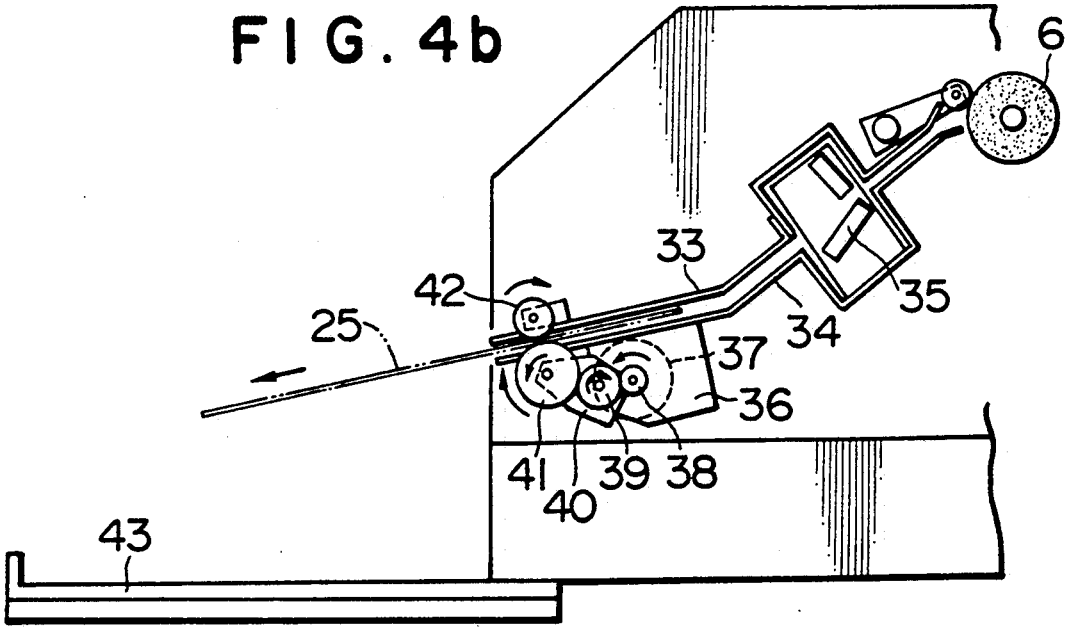
Figure 5A:
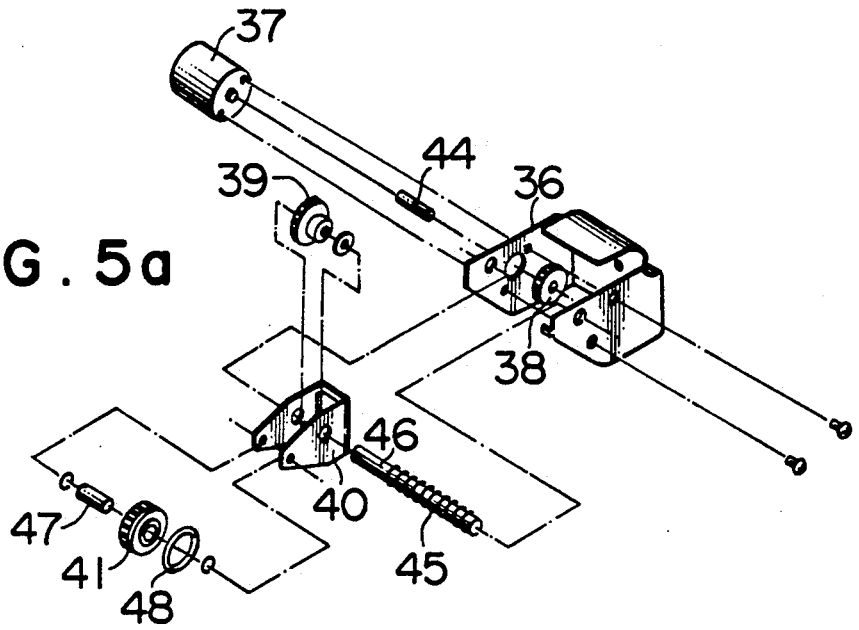
Figure 5B:
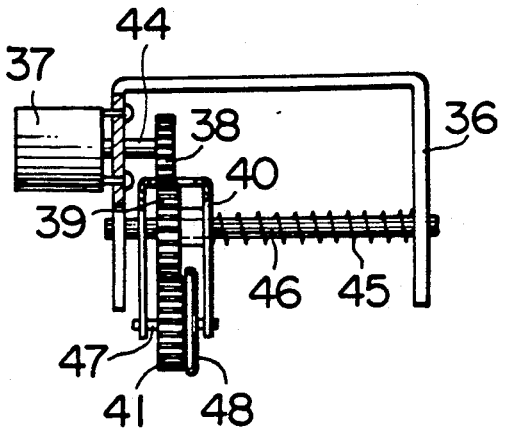
Figure 5C:
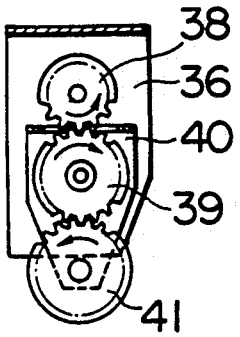
Figure 6C:
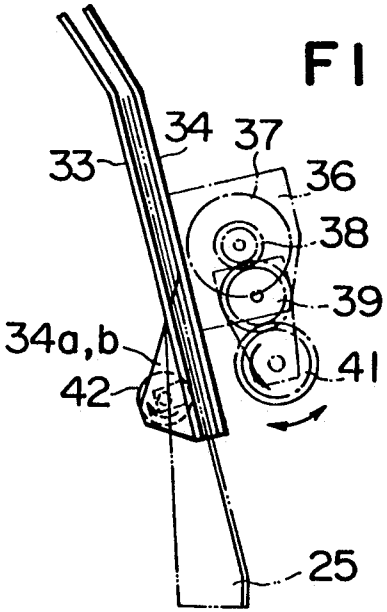
Figure 6A:
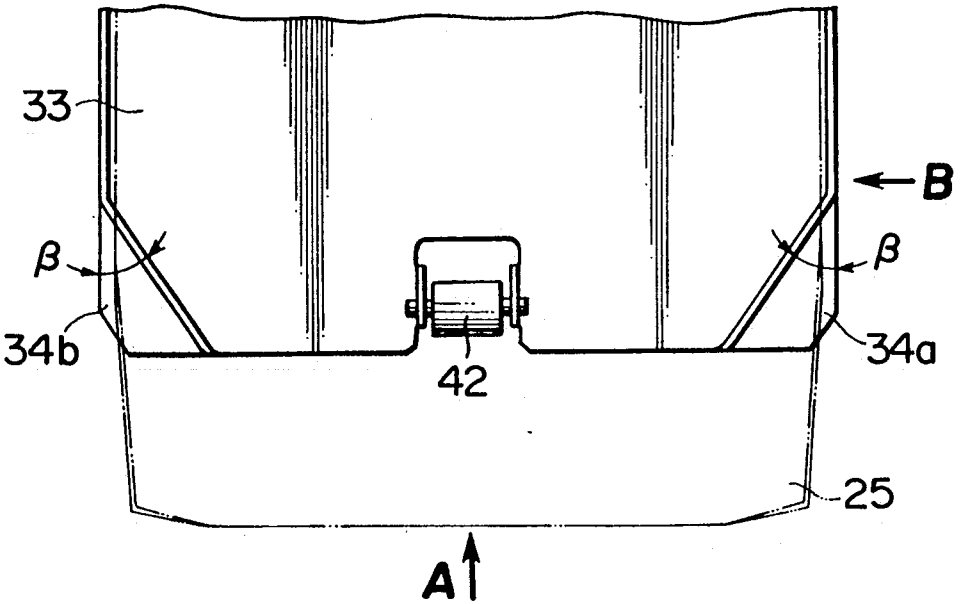
Figure 6B:
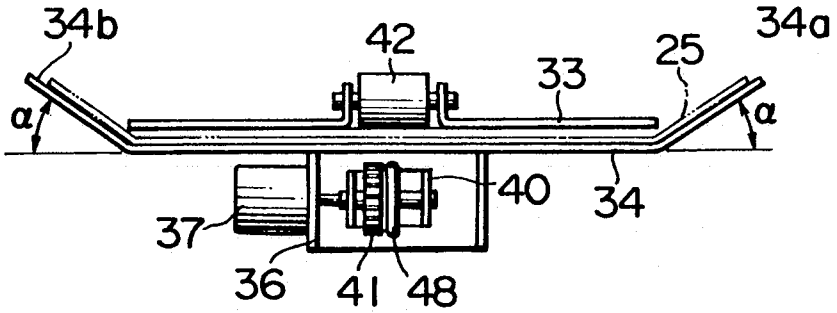

FIGS. *2a, 2b* are diagrams illustrating the state of paper feeding and printing;

FIG. 3 is a partial perspective view of a conventional paper discharging device;

FIGS. *4a* and *4b* are diagrams schematically illustrating the paper discharging device of the heat transfer color printer in accordance with a first embodiment of the present invention;

FIGS. *5a, 5b,* and *5c* are detailed diagrams explaining the paper discharging device; and FIGS. *6a, 6b,* and *6c* are diagrams of the paper discharging device of the heat transfer color printer in accordance with a second embodiment of the present invention.

DESCRIPTION OF THE PREFERRED EMBODIMENTS

Referring now to the accompanying drawings, description will be given of the preferred embodiments of the present invention.

EMBODIMENT 1

FIGS. *4a* and *4b* are diagrams schematically illustrating a paper discharging device of a heat transfer color printing in accordance with the present invention, in which FIG. *4a* illustrates a state of printing, while FIG. *4b* illustrates a state of discharging of the paper. In the drawings, reference numeral 6 denotes the platen roller; 33, an upper chute; 34, a lower chute; 35, a cutter; 36, a paper discharging motor bracket; 37, a paper discharging motor; 38, a paper discharging gear; 39, an intermediate gear; 40, a paper discharging lever; 41, a pulley gear; 48, a paper discharging pulley secured to one side surface of the pulley gear 41; 42, an idle roller; and 43, a stacker.

During printing, as shown in FIG. *4a,* the paper 25 reciprocates between the upper and lower chutes 33, 34 by means of the platen roller 6 and a drive roller. At that time, the paper discharging pulley 48 of the paper discharging device is installed below the lower chute 34 and at a position which does not hamper the reciprocating motion of the paper 25.

At the time of discharging the paper 25 upon completion of multicolor printing, as shown in FIG. *4b,* the paper is first cut to a prescribed length by the cutter 35, and the paper discharging motor 37 rotates counterclockwise. Accordingly, the intermediate gear 39 which is in contact with the paper discharging gear 38 rotates clockwise. The paper discharging pulley 48 rotates counterclockwise and, at the same time, undergoes planetary motion round the intermediate gear 39, while the paper discharging pulley 48 is raised by the paper discharging lever 40 up to a position at which the paper discharging pulley 48 abuts against the idle roller 42.

Thus, the paper 25 is pinched between the idle roller 42 and the paper discharging pulley 41 and is discharged onto the stacker 43.

FIGS. *5a, 5b,* and *5c* are diagrams illustrating a specific example of the paper discharging device used in the heat transfer color printer of the present invention in which FIG. *5a* is an exploded perspective view, FIG. *5b* is a top plan view of an assembled state, and FIG. *5c* is a schematic side elevational view of FIG. *5b.* In the drawings, reference numeral 44 denotes a shaft; 45, a compression spring for pressing the paper discharging lever 40; 46, a shaft; 47, a pulley shaft; 48, a paper discharging pulley. Namely, and the paper discharging gear 38 is rotated by the paper discharging motor 37 with the shaft 44 as its axis. When the paper discharging gear 38 rotates counterclockwise, the intermediate gear 39 rotates clockwise. At this time, the paper discharging lever 40 and the intermediate gear 39 are brought into contact with each other by the spring 45, and the paper discharging lever 40 rotates clockwise in concert with gear 39 with the shaft 46 as a center. The paper discharging pulley 48 is provided to a tip of the paper discharging lever 40 via the pulley shaft 47. This paper discharging pulley 48 is located on the lower chute 34 and rotates counterclockwise to discharge the paper 25.

Meanwhile, when the motor 37 does not rotate, the counterclockwise rotational force of the paper discharging lever 40 produced by its own weight overcomes a retaining force of the spring 45 for retaining the paper discharging lever 40, and the paper discharging pulley 48 is thus located below the lower chute 34.

As has been described above, in accordance with the present invention, since a simple and compact paper discharging device is provided to the paper discharging chute, it is possible to effect the discharging of the paper and the vertical motion of the paper discharging pulley by driving the motor.

EMBODIMENT 2

The paper 25 is wound around the paper holder 26 into the form of a roll, and therefore tends to be curled on the stacker 43 when the paper 25 is discharged from the upper and lower chutes 33, 34. When each sheet of the paper 25 becomes curled on the stacker 43, the advance of the paper 25 discharged consecutively becomes hampered, thereby possibly causing jamming of the paper.

Accordingly, in this embodiment, the upper and lower chutes are provided with the following contrivance.

FIGS. *6a, 6b,* and *6c* are diagrams schematically illustrating the paper discharging device, in which FIG. *6a* is a top plan view, FIG. *6b* is a side elevational view taken in the direction of the arrow A, and FIG. *6c* is a side elevational view taken in the direction of the arrow B. In the drawings, reference numeral 33 denotes the upper chute; 34, the lower chute; 34A, 34B are bent portions; 36, the paper discharging motor bracket; 37, the paper discharging motor; 38, the paper discharging gear; 39, the intermediate gear; 40, the paper discharging lever; 41, a pulley gear; 48, the paper discharging pulley secured to one side surface of the pulley gear 41, and 42 the idle roller.

During printing, the paper 25 reciprocates between the upper and lower chutes 33, 34. At that time, the paper discharging pulley 48 of the paper discharging device is installed below the lower chute 34 and at a position which does not hamper the reciprocating motion of the paper 25.

At the time of discharging the paper 25 upon completion of multicolor printing, the paper is first cut to a prescribed length by the cutter, and the paper discharging motor 37 rotates counterclockwise. Accordingly, the intermediate gear 39 which is in contact with the paper discharging gear 38 rotates clockwise. The paper discharging pulley 48 rotates counterclockwise and, at the same time, undergoes planetary motion round the intermediate gear 39, while the paper discharging pulley 48 is raised by the paper discharging lever 40 up to a position at which the paper discharging pulley 48 abuts against the idle roller 42.

Thus, the paper 25 is pinched between the idle roller 42 and the paper discharging pulley 41 and is discharged onto the stacker 43.

When the paper 25 is discharged, side end portions of the paper 25 are bent by an angle $\alpha$ by means of the bent portions 34*a*, 34*b* provided at corners of the side end portions of the lower chute 34 on the paper discharging side. Since this angle $\alpha$ is provided in the opposite direction to the winding direction of the paper 25 around the paper holder 26, when the paper is discharged through the upper and lower chutes 33, 34, the tendency of the paper 25 to become curled into the form of a roll is corrected. Accordingly, even if pieces of the paper 25 are discharged consecutively, the previously discharged paper does not hamper the advance of the paper to be discharged next, so that it is possible to provide a heat transfer color printer which is free from jamming.

As has been described above, in accordance with the present invention, since a simple and compact paper discharging contrivance is provided to the paper discharging chute, it is possible to effect the discharging of the paper and the vertical motion of the paper discharging pulley by driving one motor, so that the arrangement of the paper discharging device becomes very simple.

In addition, in the present invention, since at least one side end portion of at least the lower chute is bent, it is possible to prevent the paper from becoming curled into the form of a roll, so that the advance of the sheets of paper discharged onto the stacker is not hampered, thereby allowing the occurrence of jamming to be prevented.

What is claimed is:

1. A printer comprising:

a pair of upper and lower chutes for guiding printer paper;

an idle roller provided on said upper chute;

a paper discharging motor bracket provided on said lower chute;

a motor mounted on said paper discharging motor bracket and having a rotary shaft;

a paper discharging gear fitted on the rotary shaft of said motor inside of said paper discharging motor bracket;

a fulcrum shaft arranged inside of said paper discharging motor bracket in parallel with the rotary shaft of said motor;

a U-like paper discharging lever disposed rotatably about said fulcrum shaft and having a forward end;

an intermediate gear provided inside of said paper discharging lever so as to be coaxial with said fulcrum shaft and to be rotatable about said fulcrum shaft, said intermediate gear making contact with said paper discharging gear;

a spring urging said paper discharging lever in a thrust direction so as to press the latter against said intermediate gear;

a pulley shaft arranged inside of said paper discharging lever at the forward end thereof in parallel with said fulcrum shaft;

a pulley gear meshed with said intermediate gear so as to be rotated about said pulley shaft while having one side surface; and a paper discharging pulley fixed on said one side surface of said pulley gear so as to be rotatable about said pulley shaft and having a diameter greater than that of said pulley gear;

wherein said paper discharging lever is rotated by a driving force of said motor provided on said bracket to cause contact to occur between said idle roller and said paper discharging pulley, thereby discharging the paper.

2. A printer according to claim 1, wherein at least one side end portion of at least said lower chute on the paper discharging side is bent in the opposite direction to a winding direction of the paper around a paper holder.

* * * * *